US005953921A

United States Patent [19]

Garrett

[11] Patent Number: 5,953,921

[45] Date of Patent: Sep. 21, 1999

[54] TORSIONALLY RESONANT TOROIDAL THERMOACOUSTIC REFRIGERATOR

[75] Inventor: Steven L. Garrett, State College, Pa.

[73] Assignee: The United States of America as represented by the Secretary of the Navy, Washington, D.C.

[21] Appl. No.: 09/005,980

[22] Filed: Jan. 13, 1998

Related U.S. Application Data

[60] Provisional application No. 60/035,857, Jan. 17, 1997.

[51] Int. Cl.[6] ..... F25B 19/00

[52] U.S. Cl. ..... 62/6; 60/520; 62/467

[58] Field of Search ..... 62/6, 51.1, 467; 60/520

[56] References Cited

U.S. PATENT DOCUMENTS

| | | | |
|---|---|---|---|
| 4,398,398 | 8/1983 | Wheatley et al. | 62/467 |
| 4,489,553 | 12/1984 | Wheaetly et al. | 60/516 |
| 4,722,201 | 2/1988 | Hofler et al. | 62/467 |
| 5,165,543 | 11/1992 | Heyda et al. | 206/400 |
| 5,275,002 | 1/1994 | Inoue et al. | 62/6 |
| 5,319,938 | 6/1994 | Lucas | 62/6 |
| 5,339,640 | 8/1994 | Reinke | 62/6 |
| 5,647,216 | 7/1997 | Garrett | 62/6 |

*Primary Examiner*—Ronald Capossela
*Attorney, Agent, or Firm*—Donald E. Lincoln

[57] ABSTRACT

This invention for the production of high amplitude acoustic standing waves, which can be used for thermoacoustic heat transport purposes, describes the use of a rigid barrier in place of a piston, thereby allowing the suspension of the resonator to be external to the pressurized resonator and allowing an independent choice of motor mechanism, including the use of rotary motors instead of linear motors, while incidently providing a mechanism for circulating external heat transport fluids without requiring additional pumps or heat pipes.

9 Claims, 2 Drawing Sheets

TORSIONALLY RESONANT TOROIDAL THERMOACOUSTIC REFRIGERATOR

This nonprovisional patent application claims the benefit of a copending provisional application, provisional application Ser. No. 60/035,857 filed on Jan. 17, 1997.

BACKGROUND OF THE INVENTION

1. Field of the Invention

This invention relates to generation of high amplitude standing waves, fluid pumps and refrigerators and, more specifically, to thermoacoustic cooling engines.

2. Description of the Related Art

Over the past fourteen years, there has been an increasing interest in the development of acoustical cooling engines for a variety of commercial, military and industrial applications. Interest in thermoacoustic cooling has escalated with the ban in production of chlorofluorocarbons (CFCs) which was imposed at the end of 1995 under the terms of the Montreal Protocols. Thermoacoustic cooling is an attractive alternative due to the fact that it can use inert gases. These gases do not participate in chemical reactions and are therefore neither toxic nor flammable. They do not contribute to stratospheric ozone depletion, global warming, production of acid rain, or any other environmental degradation that could lead to domestic or international legislative restrictions now or in the future.

Prior to this invention, all electrically driven thermoacoustic cooling engines have used a stationery resonator which was driven by a vibrating pistons. S. L. Garrett, "ThermoAcoustic Life Sciences Refrigerator: A preliminary design study," NASA Tech. Report No. LS-10114, L. B. Johnson Space Center, Life Sciences Directorate, Houston, Tex. (Oct. 30, 1991); S. L. Garrett, J. A. Adeff and T. J. Holler, "Thermoacoustic Refrigerator for Space Applications," *J. Thermophysics and Heat Transfer,* Vol. 7, No. 4, pp. 595–599 (1993); S. L. Garrett, "High-Power Thermo-Acoustic Refrigerator," U.S. patent application Ser. No. 08/520,974 [U.S. Pat. No. 5,647,216 (Jul. 15, 1997)]. This choice of excitation required (i) a motor mechanism (which has typically been an electrodynamic drive which is similar to conventional loudspeakers), (ii) an elastic suspension system to provide resonant cancellation of the driver/piston moving mass, and (iii) a flexure seal, such as a metal bellows, that isolated the front surface of the piston, which would drive the thermoacoustic load, from the out-of-phase volumetric velocity of the opposite surface, which could cancel the desired effects of the front surface.

In previous designs these three functions were combined in a driver single unit. This forced compromises which did not permit the separate optimization of the individual functions. Since the suspension had to be housed with the voice-coil/magnet structure of the electrodynamic motor mechanism, the size and design of the suspension "springs" were limited. The number and type of suitable alternative motor mechanisms were also severely constrained in previous designs. If a motor was located outside the pressurized resonator, then another flexible seal was required to bring the force of the external motor into the pressurized thermoacoustic resonator. The requirement for a flexible piston seal which could withstand the fatigue induced by one-hundred billion cycles over a fifteen-year lifetime limited the available piston excursion and the acceptable differential pressure across the flexure seal.

SUMMARY OF THE INVENTION

The present invention eliminates the above design constraint for production of high amplitude acoustic standing waves used for thermoacoustic heat transport or other purposes by (i) allowing the use of a rigid barrier in place of a piston with a flexure seal, (ii) allowing the suspension to be external to the pressurized resonator and independent of the motor mechanism, (iii) allowing an independent choice of motor mechanisms, including the use of rotary motors instead of linear motors, and incidentally (iv) providing a mechanism for circulating external heat transport fluids without requiring additional pumps or heat pipes.

The purpose of this invention is to provide an electrically driven device which is capable of efficiently and inexpensively generating high amplitude acoustic standing waves [e.g., Lucas, U.S. Pat. No. 5,319,938 (June 1994)] and exploiting the principles of thermoacoustic heat transport (see J. C. Wheatley, G. W. Swift and A. Migliori, "Acoustical Heat Pumping Engine," U.S. Pat. No. 4,398,398 (Aug. 16, 1983); J. C. Wheatley, G. W. Swift and A. Migliori, "Intrinsically Irreversible Heat Engine," U.S. Pat. No. 4,489,553 (Dec. 25, 1984); T. J. Hofler, J. C. Wheatley, G. W. Swift and A. Migliori, "Acoustic Cooling Engine," U.S. Pat. No. 4,722,201 (Feb. 2, 1988)) and is capable of providing hundreds or thousands of watts of useful cooling power over temperature spans between the hot and cold heat exchangers in the range of 15 to 70 degrees Celsius (15° C.<$\Delta T_{ex}$<70° C). This combination of heat pumping capacity and range of temperature spans is of particular commercial interest in a wide variety of applications including, but not limited to, domestic food refrigerator/freezers, air conditioning and removal of heat dissipated by electronic components within devices such as computers, telecommunication devices, video displays and military consoles.

GLOSSARY

Figure 1:
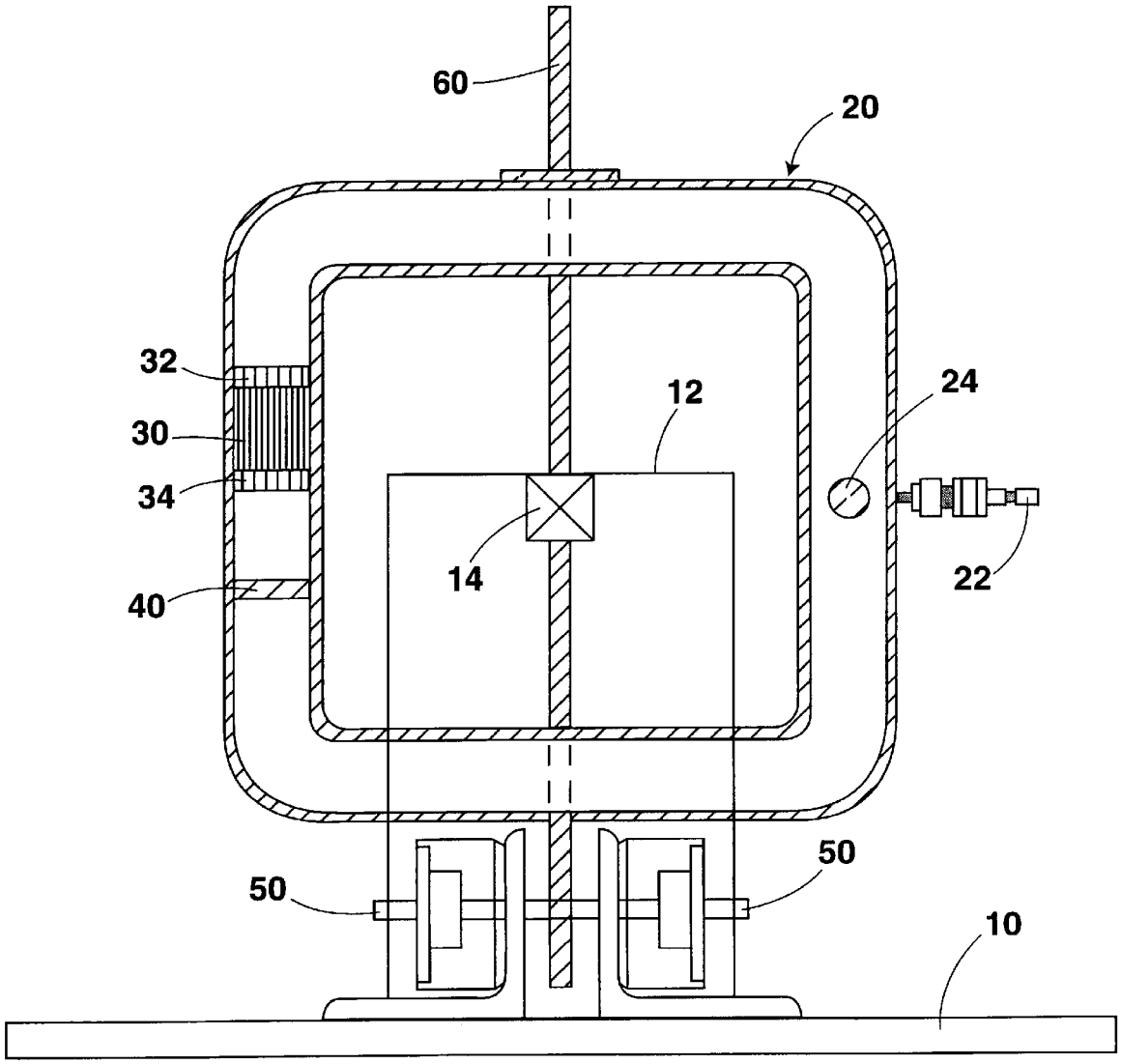
FIG. 1 depicts the Torsionally Resonant Thermoacoustic Refrigerator motor.

The following list of elements are referred to in the drawings representing a "Torsionally Resonant Toroidal Thermo-Acoustic Refrigerator"

10 Immovable and Rigid Support Structure Base
12 Upright Supports
14 Fixed Hub or Axle
20 Acoustical Resonator
22 Tube gas fill port
24 Obstacle
30 Thermoacoustic Heat Pumping Stack
32 Cold Heat Exchanger
34 Hot Heat Exchanger
35 Second Thermoacoustic Heat Pumping Stack
40 Rigid, Impermeable Barrier
50 Driver Motor Mechanism
51 Permanent Magnet
52 Permanent Magnet
53 Electrical Coil
56 Transformer
60 Flat Metal Suspension Spring
65 Yoke
66 Tuning Mass
67 Screw

68 Tuning Nut
70 Heat Exchange Fluid Tubes
80 Hollow Torsional Spring "Suspension" Tube

DETAILED DESCRIPTION OF THE INVENTION

The torsionally resonant toroidal thermoacoustic refrigerator (TRTTAR) is a radical departure from previous thermoacoustic refrigerator designs. In a conventional thermoacoustic refrigerator, the resonator (which contains the pressurized inert gas working fluid, the heat exchangers and stack) is rigidly fixed. An acoustic standing wave is maintained in the gas within the acoustical resonator by the motion of the moving piston. The TRTTAR maintains the acoustic standing wave by having the entire resonator undergo oscillation which causes the rigid barrier to impart the required force to the gas. The frequency of oscillation of the torsional resonator oscillations is chosen so that both surfaces of the barrier impart energy to the gas undergoing acoustic oscillations at the same frequency as the oscillating resonator tube.

A Simple Embodiment

The first embodiment of this new thermoacoustic device (see J. W. Osborne, "Toroidal ThermoAcoustic Refrigerator," Master's Thesis, Naval Postgraduate School, Monterey, Calif. September, 1995) is shown in FIG. 1. The acoustical resonator (20) consists of a tube (in this case having a circular cross-section) which has been formed into a toroid which has the shape of a square with rounded corners. The tube has a gas fill port (22) to permit filling with pressurized inert gas or inert gas mixtures. The obstacle (24), is simply a rod that has been inserted into acoustical resonator (20), close to the fill port (22), so that the higher frequency overtones of the standing wave modes are not harmonically related to the fundamental half-wavelength standing wave resonance in order to suppress shock wave formation (see S. L. Garrett, "High-Power ThermoAcoustic Refrigerator," U.S. patent application Ser. No. 08/520,974 [U.S. Pat. No. 5,647,216 (Jul. 15, 1997)].

The acoustical resonator (20) contains a rigid, impermeable barrier (40) and a thermoacoustic heat pumping stack (30). A hot (34) and cold (32) heat exchanger are placed adjacent to stack (30) in order to apply the useful cooling load to the cold end of the stack and remove the exhaust heat plus work from the hot end of the stack.

An immovable and rigid support structure consisting of a base (10), upright supports (12), and a fixed hub or axle (14), is connected to the acoustical resonator (20) by a flat metal suspension spring (60) which is rigidly affixed to both hub (14) and acoustical resonator (20). The combination of the elastic restoring torque provided by suspension spring (60) and the moment of inertia of acoustical resonator (20), constitute a torsional mechanical resonator which allows driver mechanism (50) to provide substantially larger angular rotational amplitudes at the resonance frequency of the suspension spring (60) and acoustical resonator (20) than would be possible at a frequency which is not one of the mechanical resonance frequencies.

In FIG. 1, the driver (50) is shown as a pair of opposed solenoid magnet actuators although any motor mechanism capable of providing the proper force and displacement at the appropriate mechanical resonance frequency would be equally acceptable. It should be pointed out explicitly that there are several mechanical resonance frequencies which correspond to rigid-body oscillatory rotation of the acoustical resonator (20) but to different flexural modes of the suspension spring (60) with nodes at other locations along the spring other than the one at hub (14). This multiplicity of resonance frequencies can be used to advantage because it allows operation at higher frequencies than the fundamental torsional resonance corresponding to rigid-body oscillatory rotation of the acoustical resonator (20) and simple flexure of the suspension spring (60) with a single node located at the hub (14).

The standing wave resonance frequency of the gas contained within acoustical resonator (20) corresponds to one-half of an acoustic wavelength between the front and rear surfaces of the barrier. The mechanical resonance of the acoustical resonator (20) and the suspension spring (60) is chosen to be the same as the acoustic standing wave frequency. This coincidence of mechanical and acoustical resonance can be created by proper choice of the mean circumference of the acoustical resonator (20) for a given gas mixture, prior to construction, or can be adjusted after construction by modifying the sound speed of the inert gas mixture within the acoustical resonator (20). The sound speed is adjusted by controlling the concentration of the lighter inert gas species (e.g., helium or neon) and the heavier inert gas species (e.g., argon, krypton or xenon) as described in an earlier patent application, S. L. Garrett, "High-Power ThermoAcoustic Refrigerator," U.S. patent application Ser. No. 08/520,974 [U.S. Pat. No. 5,647,216 (Jul. 15, 1997)].

The excitation of the standing wave resonance in the acoustical resonator (20) can be understood by recognizing that the phase of the motion of the gas and the motion of the barrier are opposite when the resonator and gas mixture are co-resonant. While the barrier is rotating in the clockwise direction, the gas is sloshing in the counter-clockwise direction. The pressure is higher on the advancing face of the barrier and lower on the opposite face. Net work is therefore done by the barrier on the gas thereby maintaining the high amplitude acoustic standing wave which is dissipated by the acoustic heat pumping process occurring within the stack and within the heat exchangers and/or by thermoviscous losses at the surface of the acoustical resonator. During the other half-cycle of oscillation, the barrier motion is counter-clockwise and the sloshing of the gas is clockwise. Once again, the barrier is doing net work on the gas and again providing the necessary power to maintain the high amplitude acoustic standing wave.

It is worthwhile to pause here momentarily to recognize that this new TRTTAR has succeeded in maintaining the high-amplitude acoustic standing wave necessary to produce the desired thermoacoustic heat pumping effect without the use of a piston or sliding seal. This was accomplished by allowing the entire acoustical resonator to oscillate and substituting a rigid barrier fixed to the oscillating acoustical resonator for the moving piston and flexure seal. The fact that the resonator can be designed to oscillate at the same frequency as that required to produce the acoustic standing wave allows an energy efficient and robust design of the driver mechanism and suspension, each component of which can now be optimized independently.

The Preferred Embodiment

Figure 2:
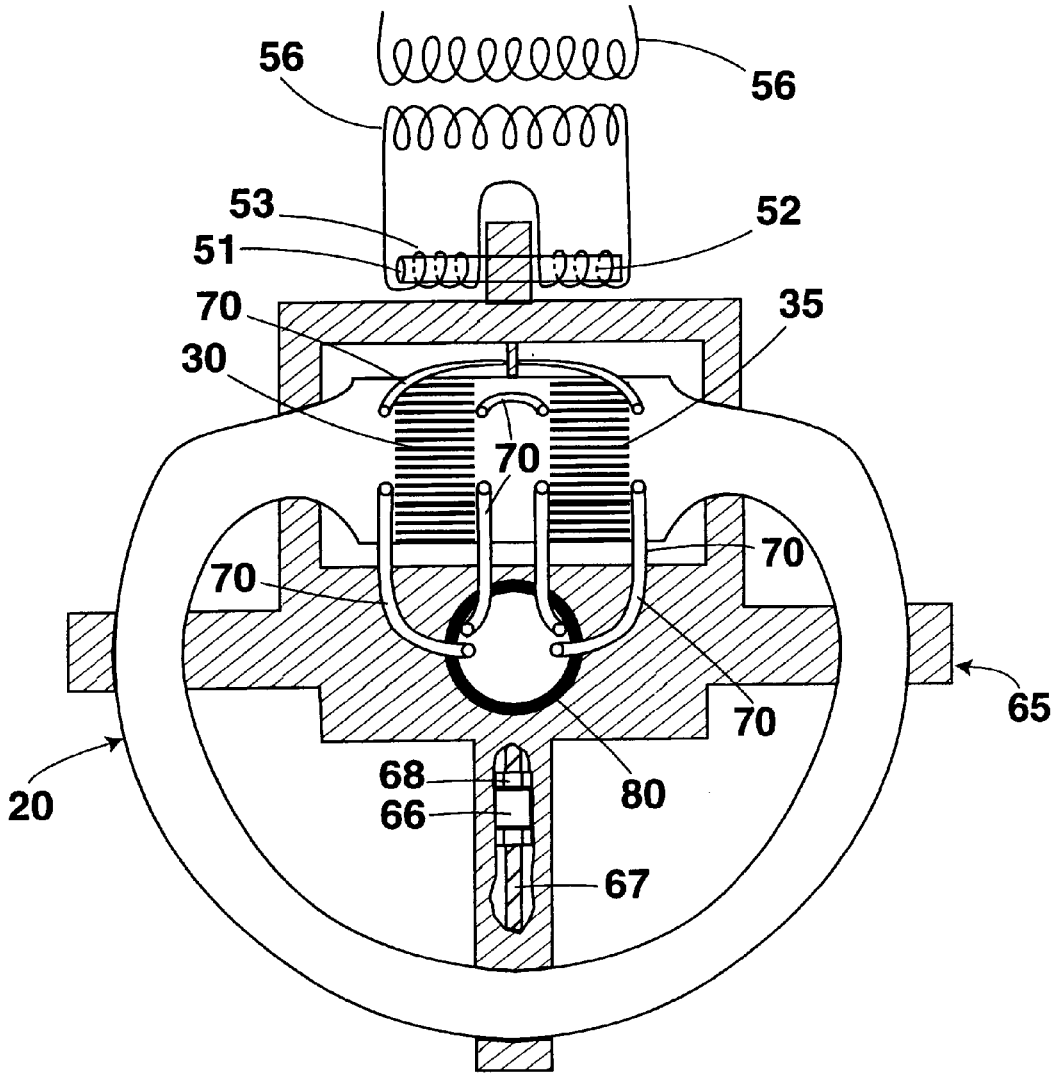
FIG. 2 is a plan view of an improvement to the motor shown in FIG. 1.
Figure 3:
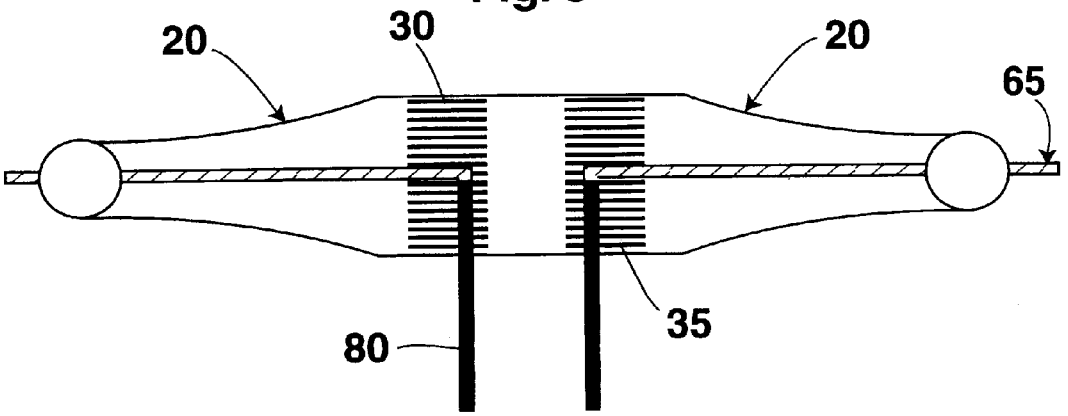
FIG. 3 is a cross sectional view of the improvement to the motor shown in FIG. 1.

An improvement to the first embodiment described above is the version shown in FIGS. 2 and 3. FIG. 2 is a plan view and below it, FIG. 3, is a cross-sectional elevation. The preferred embodiment differs from the first embodiment in several ways. Although the preferred embodiment is still a half-wavelength acoustic resonator, it now utilizes two stacks (30) and (35), for reasons described in a previous patent application, S. L. Garrett, "High-Power ThermoAcoustic Refrigerator," U.S. patent application Ser. No. 08/520,974 [U.S. Pat. No. 5,647,216 (Jul. 15, 1997)]. The four heat exchangers associated with the two stacks (30 and 35) are not shown.

In the preferred embodiment, the acoustical resonator (20) is rigidly attached to a hollow "suspension" tube (80) of inner radius $r_i$, outer radius $r_o$, and tube wall thickness $t=r_o-r_i$. Here it is the elasticity of the "suspension" tube (80) which provides the restoring torque which resonates with the moment of inertia of the acoustical resonator (20). The attachment of the acoustical resonator (20) to the "suspension" tube (80) is provided by the yoke (65) that is also rigidly attached to the motor mechanism (50). The yoke (65) includes a tuning mass (66) which is attached to a screw (67) to permit the mass to be moved toward or away from the center of the "suspension" tube (80) in order to modify the moment of inertia of the torsionally oscillating mass consisting of the yoke (65), the acoustical resonator (20) and the tuning mass (66). This adjustable moment of inertia allows fine tuning of the mechanical resonance frequency of the torsional oscillator. Although this tuning may be unnecessary, it could be used to compensate for small differences in the assembly, which could effect resonance frequency, at the end of a production line.

The motor (50) has been shown schematically in FIG. 2 as consisting of two permanent magnets (51) and (52) which are rigidly affixed to the yoke (65) and which reside within an electrical coil (53) whose oscillating magnetic field interacts with the magnets (51 and 52) to apply a tangential force to the yoke (65). This force excites the torsional resonance. The alternating electrical current which flows in the coil (53) is provide by the transformer (56).

An additional advantage illustrated by the preferred embodiment is the self-pumping capability which is provided by the centrifugal acceleration of the heat exchange fluids which pass through the heat exchange fluid tubes (70). Due to the torsional oscillations of angular amplitude $\theta$ (expressed in radians) occurring at angular frequency $\omega$ (expressed in radians/second), there is a centrifugal acceleration of the fluid at a distance R from the center of the "suspension" tube (80) which exceed the acceleration of the fluid in the tubes which pass through the hollow center of "suspension" tube (80). The magnitude of this centrifugal acceleration difference, $a_c$, between the fluid a distance R from the center of tube (80) and the fluid which is located at the center of the "suspension" tube (80) is given by, $$a_c = \frac{(R\theta\omega)^2}{R}$$

Using typical values for a small refrigerator (R=10 cm, $R\theta$=1.0 mm and $\omega$=1000 rad/sec=159 Hz, the centrifugal acceleration is equivalent to the gravitational acceleration, g=10 m/sec$^2$. It is important to recognize that the centrifugal acceleration depends only on the square of the angular displacement, $\theta$, and therefore does not change sign even though the angular displacement is oscillatory. The fluid is therefore always pumped in the same direction: up through the center of the "suspension" tube and out from the heat exchangers.

The ability to use a single motor to maintain the acoustic standing wave within the acoustical resonator and to provide the necessary power for pumping of the heat transport fluids can make a significant reduction in cost and complexity while increasing reliability and reducing radiated noise by reducing part count and eliminating the need for pump lubrication.

ADVANTAGES AND NEW FEATURES

The advantages and new features of the TRTTAR which were described in the DETAILED DESCRIPTION will be summarized briefly below:

a. The need for a failure-prone flexure seal to connect a piston to the resonator is eliminated in favor of a rigid barrier which is less expensive, less prone to fatigue failure and capable of sustaining much higher pressure differentials than metal bellows or diaphragm flexure seals used in previous designs.

b. The placement of the suspension member, which provides the restoring force (torque) necessary to resonate the moving mass (moment of inertia), outside of the pressurized resonator and independent from the drive mechanism allows for optimization of the performance (stiffness, fatigue life, materials, etc.) independent from constraints which might be imposed by the resonator or the drive mechanism.

c. The placement of the motor mechanism, which provides the force (torque) necessary to maintain the acoustic standing wave in the gas within the resonator, outside of the pressurized resonator and independent from the suspension mechanism allows for a wider choice of motor mechanisms as well as optimization of the performance of the motor independent from constraints imposed by the resonator or suspension mechanism.

d. The centrifugal acceleration provided by the torsional oscillation of the resonator can be utilized to pump the heat transport fluids which bring the useful cooling load to the cold heat exchanger and exhaust the waste heat plus mechanical work delivered by the thermoacoustic heat pumping process from the hot heat exchanger. The same motor mechanism which maintains the acoustic standing wave can provide the fluid pumping power. This reduces the number of motors and the complexity associated with a separate pumping system for the heat transport fluids.

e. The TRTTAR design accommodates a simple, external frequency tuning mechanisms which can be used if the refrigerator systems have to operate at a predetermined fixed frequency such as the power line frequency (60 Hz in the US and 50 Hz elsewhere) or some harmonic of the power line frequency. This tuning can compensate for inevitable variation in low-cost mass production process.

ALTERNATIVES

One of the most attractive features of this invention is the variety of alternatives which it accommodates for selection of suspensions to provide the restoring force (torque) for the mechanical (torsional) oscillator and the variety of alternatives which it accommodates for the selection of motor mechanisms. Although both embodiments described in this disclosure utilized linear motor mechanisms to maintain the acoustical and mechanical resonances, there are several schemes which are the subject of other patent disclosures which use commonly available rotary motors to provide the oscillating torque required to maintain the mechanical and acoustical oscillations.

An alternative which uses two torsionally resonant toroidal resonators which are oscillating out-of-phase and supported by a common "suspension" tube would transmit no unbalanced vibration to the support base if the base were attached to the center of the common "suspension" tube.

An alternative which uses a single torsionally resonant toroidal resonator with a "suspension" tube which passes through the support on a bearing with counter-rotating masses at the two ends of the "suspension" tube, beyond the bearing, would also provide a system which communicates no unbalanced vibration to the base.

Obviously many modifications and variations of the present invention are possible in light of the above teachings. It is, therefore, to be understood that the present invention may be practiced within the scope of the following claims other than as specifically described.

What is claimed is:

1. A Torsionally Resonant Toroidal Acoustic Resonator, comprising:

at least one half-wavelength high amplitude sound torsional resonator, said resonator having a rigid, impermeable barrier, a driver motor for imparting a torsional oscillation to the resonator, a suspension mechanism fixedly attaching the resonator to the driver motor for providing restoring torque that will resonate with the moment of inertia of the resonator, constituting a torsional mechanical resonator for the driver motor to provide excitation at the resonant frequency, and a gas or gas mixture disposed within the resonator, said gas having a standing wave resonance frequency corresponding to one or more halves of an acoustic wavelength between the front and rear surfaces of the barrier, so that as the rigid barrier oscillates at the frequency of the torsional resonator's oscillations it imparts a force to the gas and generates large amplitude acoustic standing waves.

2. The Torsionally Resonant Toroidal Acoustic Resonator of claim 1, further comprising:

an immovable, rigid support base, and at least one support affixed to the base, said support having an axle or hub affixed thereto for supporting the suspension mechanism which provides the restoring torque.

3. The Torsionally Resonant Toroidal Acoustic Resonator of claim 1, wherein said drive motor is fixedly attached to said suspension mechanism between two said resonators.

4. The Torsionally Resonant Toroidal Acoustic Resonator of claim 1, wherein the suspension mechanism is a flat spring.

5. The Torsionally Resonant Toroidal Acoustic Resonator of claim 1, wherein the suspension mechanism is a tube.

6. A Torsionally Resonant Toroidal ThermoAcoustic Refrigerator, comprising:

at least one half-wavelength high amplitude sound torsional resonator, said resonator having a rigid, impermeable barrier, at least one heat pumping stack, at least one cold heat exchanger and at least one hot heat exchanger disposed therein for cooling the stack and removing heat plus work from the hot end of the stack, a driver motor for imparting an oscillation to the resonator, a suspension spring fixedly attaching the resonator to the driver motor for providing restoring torque that will resonate with the moment of inertia of the resonator, constituting a torsional mechanical resonator for the driver motor to provide excitation at the resonant frequency, a gas or gas mixture disposed within the resonator, said gas having a standing wave resonance frequency corresponding to one or more halves of an acoustic wavelength between the front and rear surfaces of the barrier, so that as the rigid barrier oscillates at the frequency of the torsional resonator's oscillations it imparts a force to the gas and generates work which is removed from the hot heat exchanger, an immovable, rigid support base, and at least one support affixed to the base, said support having an axle or hub affixed thereto for supporting the suspension spring mechanism which provides the restoring torque.

7. A Torsionally Resonant Toroidal ThermoAcoustic Refrigerator, comprising:

at least one half-wavelength high amplitude sound torsional resonator, said resonator having a rigid, impermeable barrier, at least one heat pumping stack, at least one cold heat exchanger and at least one hot heat exchanger disposed therein for cooling the stack and removing heat plus work from the hot end of the stack, a driver motor for imparting an oscillation to the resonator, a suspension tube fixedly attached to two resonators and supporting the driver motor therebetween for providing restoring torque that will resonate with the moment of inertia of the resonators, constituting a torsional mechanical resonator for the driver motor to provide excitation at the resonant frequency, and a gas or gas mixture disposed within the resonator, said gas having a standing wave resonance frequency corresponding to one or more halves of an acoustic wavelength between the front and rear surfaces of the barrier, so that as the rigid barrier oscillates at the frequency of the torsional resonator's oscillations it imparts a force to the gas and generates work which is removed from the hot heat exchanger.

8. A Torsionally Resonant Toroidal ThermoAcoustic Refrigerator, comprising:

at least one half-wavelength high amplitude sound torsional resonator, said resonator having a rigid, impermeable barrier, at least one heat pumping stack, at least one cold heat exchanger and at least one hot heat exchanger disposed therein for cooling the stack and removing heat plus work from the hot end of the stack, a driver motor for imparting an oscillation to the resonator, a suspension tube fixedly attached to two resonators and supporting the driver motor therebetween for providing restoring torque that will resonate with the moment of inertia of the resonators, constituting a torsional mechanical resonator for the driver motor to provide excitation at the resonant frequency, a gas or gas mixture disposed within the resonator, said gas having a standing wave resonance frequency corresponding to one or more halves of an acoustic wavelength between the front and rear surfaces of the barrier, so that as the rigid barrier oscillates at the frequency of the torsional resonator's oscillations it imparts a force to the gas and generates work, and at least one heat exchange fluid-filled tube extending from the hub, where it is at rest, to the heat exchanger which is executing maximum oscillation amplitudes, for providing centrifugal acceleration to pump the heat exchange fluid unidirectionally through the fluid-filled tube away from the fixed (hub) end to the position of maximum oscillation amplitude.

9. A Torsionally Resonant Toroidal ThermoAcoustic Refrigerator, comprising:

at least one half-wavelength high amplitude sound torsional resonator, said resonator having a rigid, impermeable barrier, at least one heat pumping stack, at least one cold heat exchanger and at least one hot heat exchanger disposed therein for cooling the stack and removing heat plus work from the hot end of the stack, a driver motor for imparting an oscillation to the resonator, a suspension tube fixedly attached to two resonators and supporting the driver motor therebetween for providing restoring torque that will resonate with the moment of inertia of the resonators, constituting a torsional mechanical resonator for the driver motor to provide excitation at the resonant frequency, a gas or gas mixture disposed within the resonator, said gas having a standing wave resonance frequency corresponding to one or more halves of an acoustic wavelength between the front and rear surfaces of the barrier, so that as the rigid barrier oscillates at the frequency of the torsional resonator's oscillations it imparts a force to the gas and generates work, and at least one heat exchange fluid-filled tube extending from the hub, where it is at rest, to the other (free) end executing maximum oscillation amplitudes due to its own elasticity or the elasticity of the suspension, providing centrifugal acceleration to pump the heat exchange fluid unidirectionally through the tube away from the fixed (hub) end to the free-end position of maximum oscillation amplitude.

* * * * *